US006114778A

United States Patent [19]

Rostron et al.

[11] Patent Number: 6,114,778

[45] Date of Patent: Sep. 5, 2000

[54] HIGH VOLTAGE SYNCHRONOUS SWITCH FOR CAPACITORS

[75] Inventors: Joseph R. Rostron; J. P. Werner, both of Brandon, Miss.

[73] Assignee: Siemens Power Transmission & Distribution, Inc., Wendell, N.C.

[21] Appl. No.: 08/899,364

[22] Filed: Jul. 23, 1997

[51] Int. Cl.[7] ..... H01H 35/00

[52] U.S. Cl. ..... 307/116

[58] Field of Search ..... 307/112, 113, 307/116, 125, 126, 130, 131, 100, 109, 147; 333/12; 361/18, 206, 209, 191; 218/44, 71, 152; 335/8, 9, 10

[56] References Cited

U.S. PATENT DOCUMENTS

| | | | |
|---|---|---|---|
| 3,566,055 | 2/1971 | Weston | 200/48 |
| 4,570,042 | 2/1986 | Yanabu et al. | 218/43 |
| 4,736,114 | 4/1988 | Reichl | 307/11 |
| 5,298,703 | 3/1994 | Yatsuzuka et al. | 218/44 |
| 5,684,342 | 11/1997 | Innes et al. | 307/117 |
| 5,859,398 | 1/1999 | McKean | 218/7 |

*Primary Examiner*—Richard T. Elms

[57] ABSTRACT

A contact structure for a switch that switches capacitors into multi-phase, high voltage transmission lines. There is one capacitor switch for each phase of the transmission line, and each switch has two contacts, a stationary contact and a movable contact. All of the switches begin the transition from the open to closed position at substantially the same time, and all of the movable contacts move towards their respective stationary contacts at substantially the same velocity. Each stationary contact is positioned at a predetermined distance from its movable contact when the switch is in an open position so that the time it will take for each switch is transition between the open and closed position is known. The synchronous timing of closing each switch, and therefore switching-in each capacitor into its respective high-voltage line, is achieved based on the positioning of the stationary contacts.

46 Claims, 7 Drawing Sheets

HIGH VOLTAGE SYNCHRONOUS SWITCH FOR CAPACITORS

FIELD OF INVENTION

This invention relates generally to devices for switching capacitors into high voltage distribution systems, and, more particularly, to a synchronous switching device that switches the capacitors into high voltage distribution systems, e.g., above 32 kilovolts, at predetermined times to decrease voltage transients.

BACKGROUND OF INVENTION

In a typical power distribution system, power is distributed over power transmission lines between a power generator and a load. The efficiency of such a distribution system improves when it is operated near unity power factor. The transmission of power, however, almost inevitably involves current induced magnetic fields, which leads to a lagging power factor of the distribution system. In addition, since loads vary at different times of the day, week and seasons, this lagging power factor is constantly changing.

In order to improve the efficiency of the distribution system, the power factor is often corrected by introducing a source of leading reactance to the system, such as capacitance. Consequently, capacitors are usually shunt-connected across the power transmission lines and can be either energized continuously or switched on and off during changing load cycles. Moreover, capacitors can either be grounded or ungrounded. In most cases, capacitors are automatically discharged when switched out of the system.

Switching of capacitors into a power system, however, may cause voltage transients, especially when capacitors are switched into high voltage systems, e.g., above 32 kilovolts, and particularly above 72 kilovolts. For example, in the case of a grounded capacitor, one side of the capacitor is usually connected to a substation ground plane. Switching such a capacitor into a distribution system may cause a current rush through the capacitor since it is usually at a different potential than the power line it is connected to. This causes voltage transients in the ground circuits of the substation, as well as voltage transients in the power line. Similarly, switching an ungrounded capacitor into a distribution system usually results in voltage transients in the power line, since the capacitor and power line are usually at different potentials.

These voltage transients may blow the protective fuses which are connected in series with the capacitor, decrease the lifespan of the capacitor, cause wear on the transmission line insulators, damage substation control circuitry, and cause interference with nearby electrical controls.

In cases of multiple phase transmission systems, these problems are multiplied. For example, in a three phase transmission system, three capacitors may have to be switched into the system, and, as each capacitor is switched into the system, it may cause transients. Accordingly, multiple phased distribution systems present additional complexities when switching capacitors into the system.

It is known that, in order to decrease these voltage transients, capacitors should be switched into the system at certain times. More particularly, in the case of grounded capacitors, the capacitor should be switched into the system when the voltage signal in the respective transmission line crosses zero potential. This is because the grounded capacitor is usually discharged, which places it around zero voltage potential. Thus, when the capacitor is switched into the system when the corresponding voltage signal on the transmission line is zero, the current rush and therefore the voltage transients are minimized. Similarly, in the case of multiple phase transmission systems, it is known that each grounded capacitor should be switched into its respective transmission line when the voltage in that line crosses zero potential.

In situations where ungrounded capacitors are used in multiple phase transmission systems, it is also known that, in order to decrease these voltage transients, the capacitors should be switched into its corresponding transmission line at predetermined times. Specifically, in cases of three-phase transmission systems, two capacitors should be switched in when the voltage potential in the two respective transmission lines are equal. This means the power system's differential potential is zero, which substantially corresponds with the potential on the capacitors (which is also about zero). This is followed by switching in the last capacitor when the corresponding voltage potential of its transmission line is at zero potential.

These synchronous timing requirements for switching both grounded and ungrounded capacitors in order to decrease voltage transients have led to the development of complex switching controls and mechanisms. For example, some known devices use a single control system for each phase of a multiple phase transmission system. Each control system monitors the voltage in its respective transmission line and attempts to switch in its respective capacitor at the appropriate time. This solution is expensive, bulky and complex. Moreover, its complexity leads to a decrease in reliability. Other known devices have complex mechanical linkages that, although controlled by one control system, attempt to mechanically delay the switching of some of the capacitors until the appropriate time. These mechanical devices are also expensive, bulky, complex, less reliable, and are difficult to maintain.

SUMMARY OF INVENTION

Accordingly, it is desirable to provide an inexpensive and reliable synchronous switching device for capacitors. Moreover, it is desirable to provide a synchronous capacitor switching device that accurately switches the capacitors into a multiphase transmission system at the appropriate time to decrease voltage transients. In addition, it is also desirable to provide a synchronous switching device for capacitors that is easy to manufacture, install and maintain.

The present invention uses a control device that monitors the voltage signal in a single phase of a multiple phase transmission system. The control device issues a control signal that releases a compression spring that closes a switch thereby switching-in an associated capacitor when the voltage signal in the monitored line is predicted to be at an appropriate potential.

Synchronous timing is achieved by the unique structure of the capacitor switches. Each switch comprises a stationary contact and a movable contact. Associated capacitors are connected to their respective transmission lines when the movable contact is physically moved against the stationary contact, thereby completing an electrical circuit. A compression spring is used as the force that physically moves the movable contacts against their respective stationary contacts. When the spring is actuated by the control device, a pull rod is moved, that, in turn, moves each of the movable contacts toward their respective stationary contacts at substantially the same time, and at substantially the same velocity. Synchronous switching of the capacitors is achieved by physically locating each stationary contact a predetermined distance from its respective movable contact, because it would then take more or less time for the movable contact to traverse this distance and move against its stationary contact.

More particularly, in the case of grounded capacitors in multi-phase transmission systems, it is desired to switch each capacitor into its respective line when the voltage signal in the respective line is at zero potential. In operation, the control device of the present invention detects when the voltage signal in one phase crosses zero potential. It then accounts for the mechanical delays associated with switching the corresponding capacitor for that phase, and then issues a control signal to the spring. The control signal is sent in advance of a subsequent, predicted voltage zero crossing in order to account for the predicted delay. The spring is thus actuated by the control signal, causing a corresponding capacitor switch to move its movable contact against the stationary contact at the correct, synchronous time.

At the same time, the actuation of the spring causes the other movable contacts of the other capacitor switches to also move towards their respective stationary contacts. In the present invention, the stationary contacts of the other capacitors are spaced a further, predetermined distance from their respective movable contacts. Accordingly, since these movable contacts have a further distance to travel before they completes a circuit with the stationary contact, it takes a longer time for the circuit to be completed. Thus, by prearranging these distances between the movable contact and its respective stationary contact, each subsequent capacitor can be switched at the correct, synchronous time, i.e., when the voltage signal in the corresponding transmission lines cross zero potential.

In cases of ungrounded capacitors in three-phase transmission systems, the control device of the present invention works in a similar fashion, except that the stationary contacts of the capacitor switches are prearranged at different distances from their respective movable contacts. Again, the control circuit monitors the voltage signal in a single phase of the transmission system, and accounts for the anticipated mechanical delays in switching the capacitor switch. In the case of ungrounded capacitors, the control device issues a control signal to the spring prior to the time the monitored phase is predicted to have equal potential with another phase in order to account for the delays. The spring then causes the movable contacts to move towards their respective stationary contacts at substantially the same time and velocity. The movable contacts and stationary contacts of the two capacitors that correspond to the two phases that will have the same voltage potential are spaced an equal distance apart. Therefore, these two capacitors will be switched into the system at the correct, synchronous time, i.e., when the voltage potentials in the two corresponding transmission lines are about equal. The third capacitor has its stationary contact placed a predetermined, further distance from its movable contact, and, thus, it will also be switched into the system at the correct, synchronous time, i.e., when the voltage signal in its corresponding transmission line crosses zero potential.

Preferably, in the present invention, the spring is compressed just prior to its actuation, after the control device receives a signal from a user that the capacitors should be switched into the system. This prolongs the life of the spring, and, since it is not compressed for long periods of time, helps insure that it will have substantially the same velocity during subsequent de-energizations. Moreover, the movement of the motor, gearing, bearings, spring, etc. just prior to actuation jostles and loosens the mechanical components of the system, thereby allowing for more fluid actuation of the components, which, in turn, allows for more fluid closure of the switches and more accurately timed closings.

In addition, the control device preferably includes a memory that that records the actual time it takes from issuance of the control signal that requests the spring to release, and the electrical circuit being completed by the first movable contact and stationary contact. The control device preferably has a modem so the user can selectively access this memory and analyze actual closing times. The user preferably can, via modem, periodically adjust the control device to account for timing changes due to account for variations in the actual closing time due to wear, friction, lubrication, etc.

BRIEF DESCRIPTION OF THE DRAWINGS

The accompanying drawings, which are incorporated in and constitute a part of the specification, illustrate a presently preferred embodiment of the invention, and, together with the general description given above and the detailed description of the preferred embodiment given below, serve to explain the principals of the invention.

DETAILED DESCRIPTION OF THE PREFERRED EMBODIMENT

Figure 1:
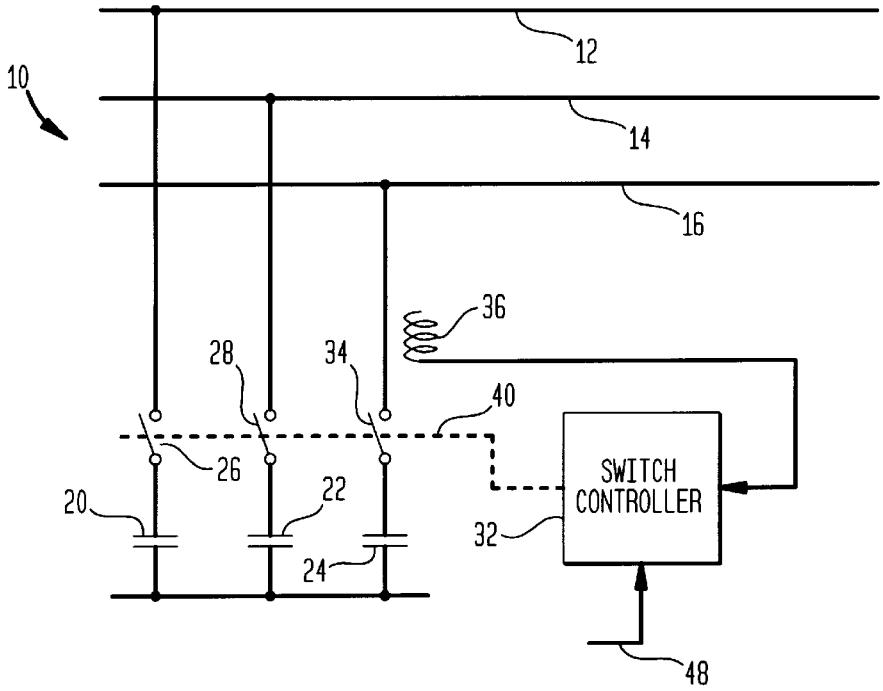
FIG. 1 is a block diagram of the capacitor switcher in a three-phase distribution system in accordance with the preferred embodiment of the present invention.

Referring to FIG. 1, a block diagram of a high voltage, three phase transmission system is shown. A three phase transmission line 10, comprising phase A line 12, phase B line 14 and phase C line 16, is connected to a capacitor bank comprising three capacitors, 20, 22 and 24. Each of these capacitors 20, 22 and 24 is connected to one side of a switch, 26, 28 and 30, respectively. These switches connect and disconnect each capacitor to a respective transmission line. For example, capacitor 20 is connected and disconnected to phase A line 12 via switch 26, capacitor 22 is connected and disconnected to phase B line 14 via switch 28, and capacitor 24 is connected and disconnected to phase C line 16 via switch 30.

The switches 26, 28 and 30 are controlled by switch controller 32. Switch controller 32 contains a synchronous controller (as described further below) that monitors the voltage signal in the phase C transmission line via station potential transformer 36 and physically moves the capacitor switches 26, 28 and 30. Switch controller 32 has an input 48 for receiving a command requesting that the capacitors be switched into the system, and an output 40 that physically moves the switches into a closed position, thereby switching the capacitors into the transmission lines. As described further below, switch controller 32 contains a synchronous controller 34 that monitors the actual time it takes to close switch 30 and uses this information to determine the mechanical delay associated with closing the switch. This information is accessible by the user and allows adjustments to be made to the synchronous controller 34 to compensate for minor mechanical fluctuations during usage, including fluctuations due to lubrication and wear.

Figure 2:
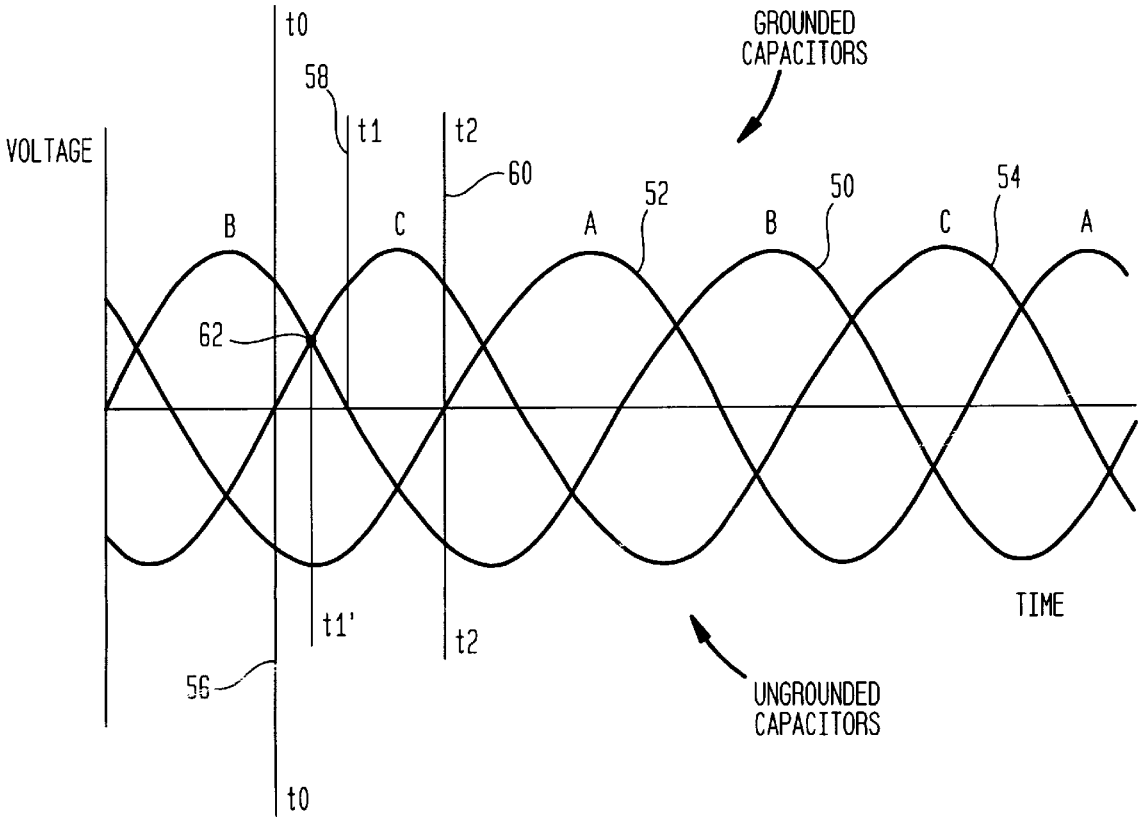
FIG. 2 is a graphical diagram of the voltage signal waveforms of a three-phase distribution system in accordance with the preferred embodiment of the present invention.

Turning to FIG. 2, a graphical diagram of the voltage signal waveforms in the three phases of transmission line 10 shown. For exemplary purposes, a 120 degree phase, 60 hertz, high voltage transmission system is shown. More particularly, the voltage signal waveform in the phase B line is shown at 50, the voltage signal waveform of phase A is shown at 52, and the voltage signal waveform of phase C is shown at 54. The signal waveforms for each phase are all AC (alternating current) signals, transmitted at 60 hertz (60 cycles a second), and each phase is offset from the other phases by 120 degrees. Accordingly, it is known that each voltage signal will cross zero potential 120 times a second, or once every 8.33 milliseconds. Also, since each phase is offset by 120 degrees, each subsequent voltage signal waveform crosses zero potential 2.78 milliseconds after the previous phase. For example, the phase C voltage signal crosses zero potential at reference numeral 56 (t0=0), the phase B voltage signal crosses zero potential at reference numeral 58 (t1=2.78 milliseconds), and the phase A voltage signal crosses zero potential at reference numeral 60 (t3=5.55 milliseconds).

Consequently, by monitoring the voltage waveform signal in the phase C line 16 via station potential transformer 36, switch controller 32 can determine when the voltage signal in that phase crosses zero potential. Furthermore, since the voltage signals of subsequent phases B and A will cross zero potential 2.78 and 5.55 milliseconds later, respectfully, the circuit switcher can predict when the voltage signals in the other two transmission lines cross zero potential. In fact, all of this information can be determined by simply monitoring the zero crossings of the voltage waveform in a single phase. As described further below, this information is useful when synchronizing the switching of grounded capacitors.

In the case of ungrounded capacitors, two of the capacitors should be switched into their respective transmission lines when the potential of voltage signals in the two phase lines is equal, followed by the third capacitor when the associated third phase crosses zero potential. This can also be accomplished by monitoring the voltage zero crossings in a single phase. Specifically, as described above, synchronous controller 34 monitors the voltage signal in the phase C transmission line 16. Since the phases are all 120 degrees apart, and the signals are being transmitted at 60 Hz, it is known that the voltage signal in the phase C line will have the same potential as the voltage signal in phase B line 1.39 milliseconds after the phase C voltage signal crosses zero potential. Similarly, it is known that the phase A voltage signal will cross zero potential 4.17 milliseconds after the voltages of phase B and C are equal.

For example, as shown in FIG. 2, the phase C line signal crosses zero potential at reference numeral 56, or t0. The phase C voltage thereafter equals the phase B voltage at reference numeral 62 or t1', which is 1.39 milliseconds after t0. Then, the phase A voltage signal crosses zero potential at reference numeral 60, or t2, which is 4.17 milliseconds after t1'. This is the information needed to synchronize the switching of ungrounded capacitor banks.

Consequently, by monitoring the voltage waveform in a single phase of any multi-phase transmission system, all of the synchronous capacitor-switching timing information can be ascertained (provided that frequency and phase of the system is known). The described three-phase, 120 degree, 60 hertz system is shown only by way of example. Of course, the described synchronous switcher could be used with any multiple-phase distribution system without deviating from the spirit or scope of the present invention.

Figure 3:
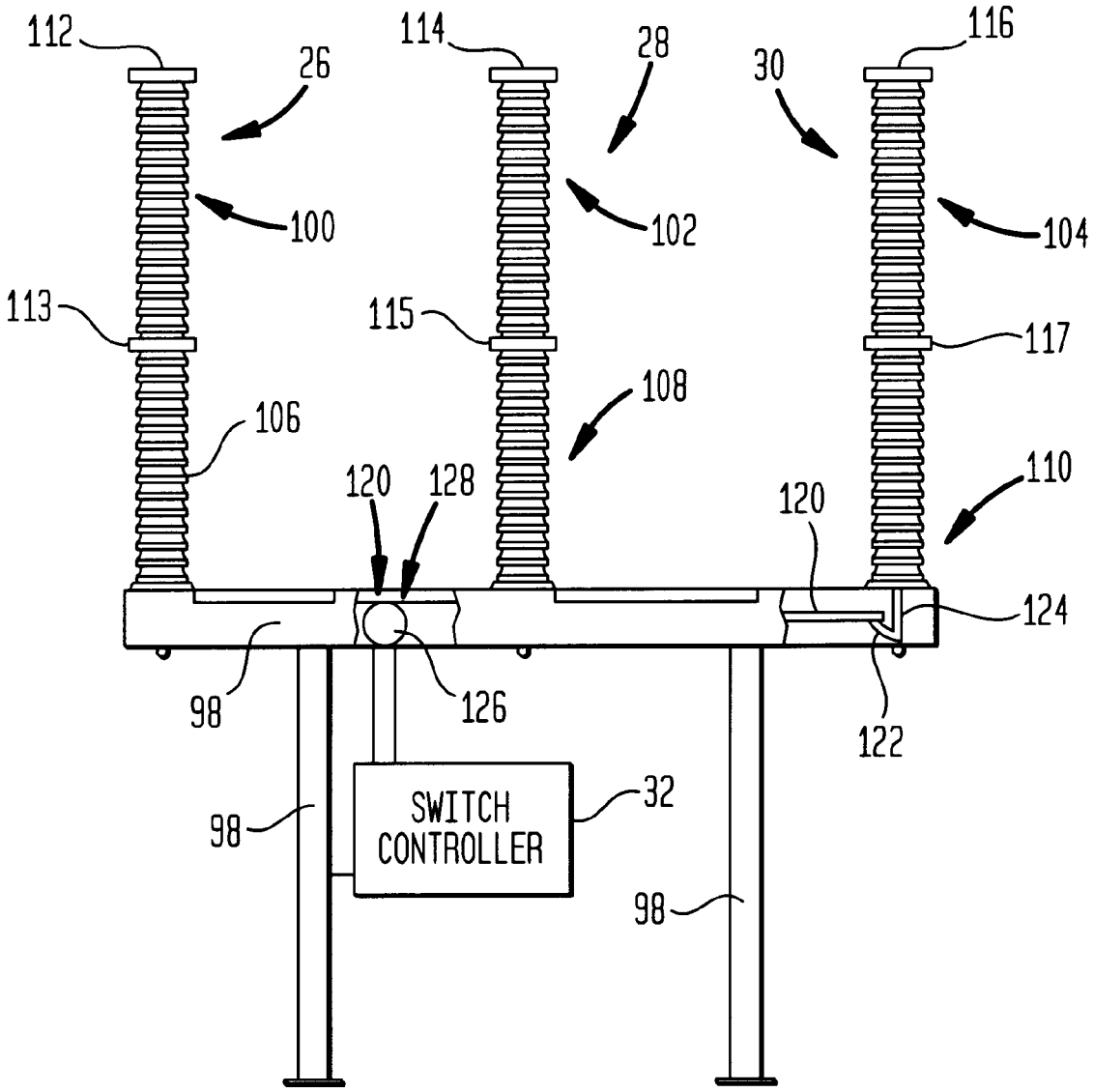
FIG. 3 is a front view of a capacitor switcher in accordance with the preferred embodiment of the present invention, with a partial cutaway view illustrating linkages in accordance with the preferred embodiment of the present invention.
Figure 5:
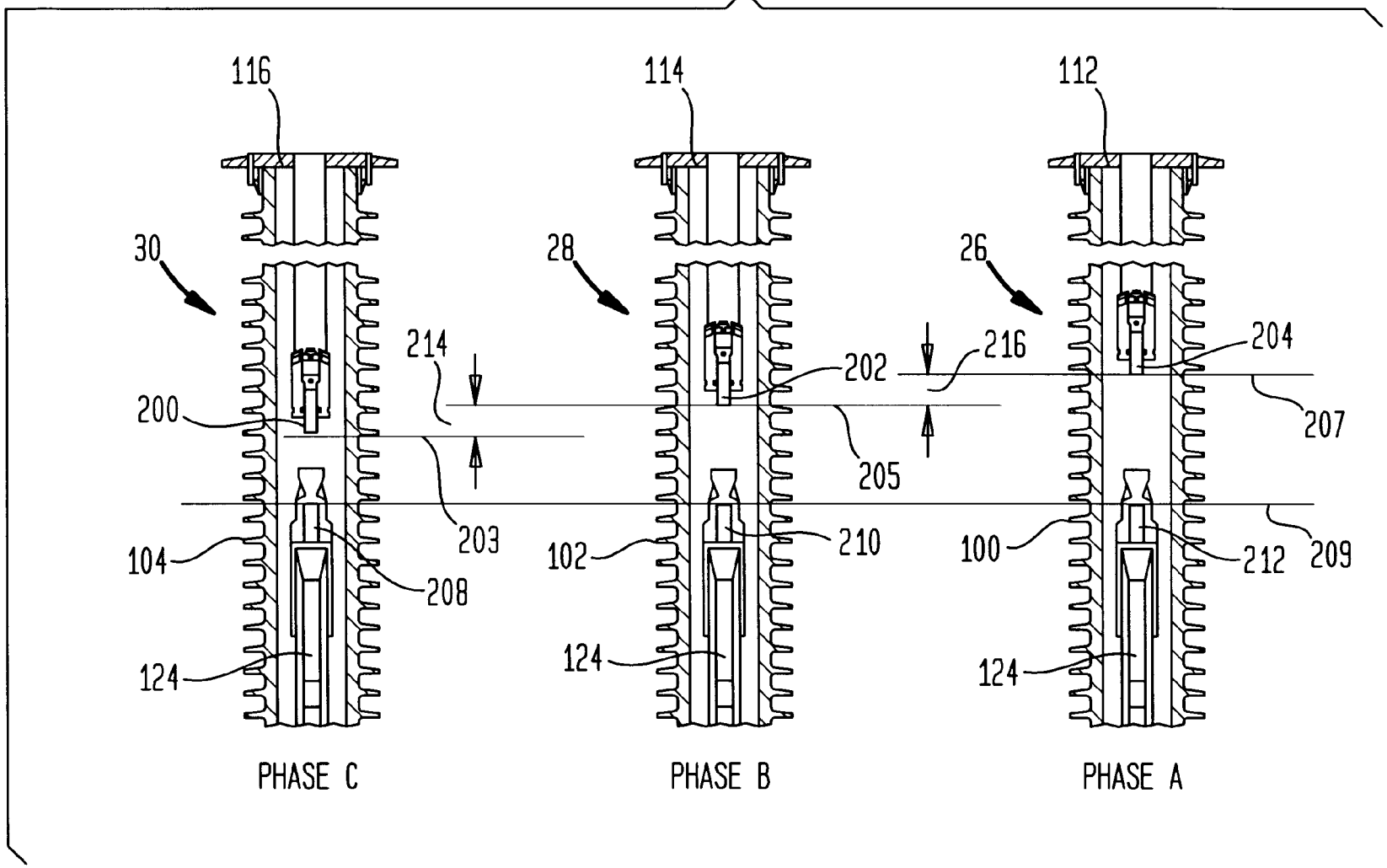
FIG. 5 is a detailed view of the contact structure of a grounded type capacitor switcher in accordance with the preferred embodiment of the present invention.

Turning now to FIG. 3 a front view of capacitor switches 26, 28 and 30 and switch controller 32 is shown. A base assembly 98 supports the capacitor switches 26, 28 and 30 and the switch controller 32. Each capacitor switch has an interrupter part 100, 102 and 104, respectively, and a insulator part 106, 108 and 110, respectively. As shown in FIG. 5, each switch 30, 28 and 26 has a stationary contact 200, 202 and 204, respectively, and a movable contact 208, 210 and 212, respectively (in FIG. 5, phase C is drawn first, followed by phases B and A). These contacts are located within the interrupter part of the switch.

Terminal pads 116, 114 and 112 are located towards the ends of each switch, and are electrically connected to the stationary contacts 200, 202 and 204, respectively. Terminal pads 117, 115 and 113 are electrically connected to the movable contacts 208, 210 and 212, respectively. These terminal pads are connected, in turn, to an associated capacitor and transmission line (e.g., terminal pad 116 of switch 30 is connected to phase C transmission line 16, and terminal pad 117 is connected to capacitor bank 24; terminal pads 112 and 113 are connected to phase A transmission line 12 and capacitor 20, respectively; and terminal pads 114 and 115 are connected to phase B transmission line 14 and capacitor 22, respectively). Consequently, when the movable contacts contact their respective stationary contacts, a conductive pathway is formed between the terminal pads of each switch, thereby connecting the transmission lines to their associated capacitors for each phase.

The base assembly 98 contains a horizontal pull rod 120. Pull rod 120 is connected via a bell crank 122 to vertical pull rods 124 within each insulator and interrupter. The pull rod 120 moves horizontally, and this horizontal movement is transferred to vertical movement of the pull rods 124 via bell cranks 122 (although not shown, the phase B and A switches have similar pull rods 124 and bell cranks 122). Movement of the horizontal pull rod 120 is controlled by actuator rod 126 that extends vertically from the switch controller 32. Another bell crank 128 converts the vertical movement of actuator rod 126 into horizontal movement of the pull rod 120, and, in turn, bell cranks 122 convert this horizontal movement of pull rod 120 back into vertical movement of pull rods 124.

Figure 4:
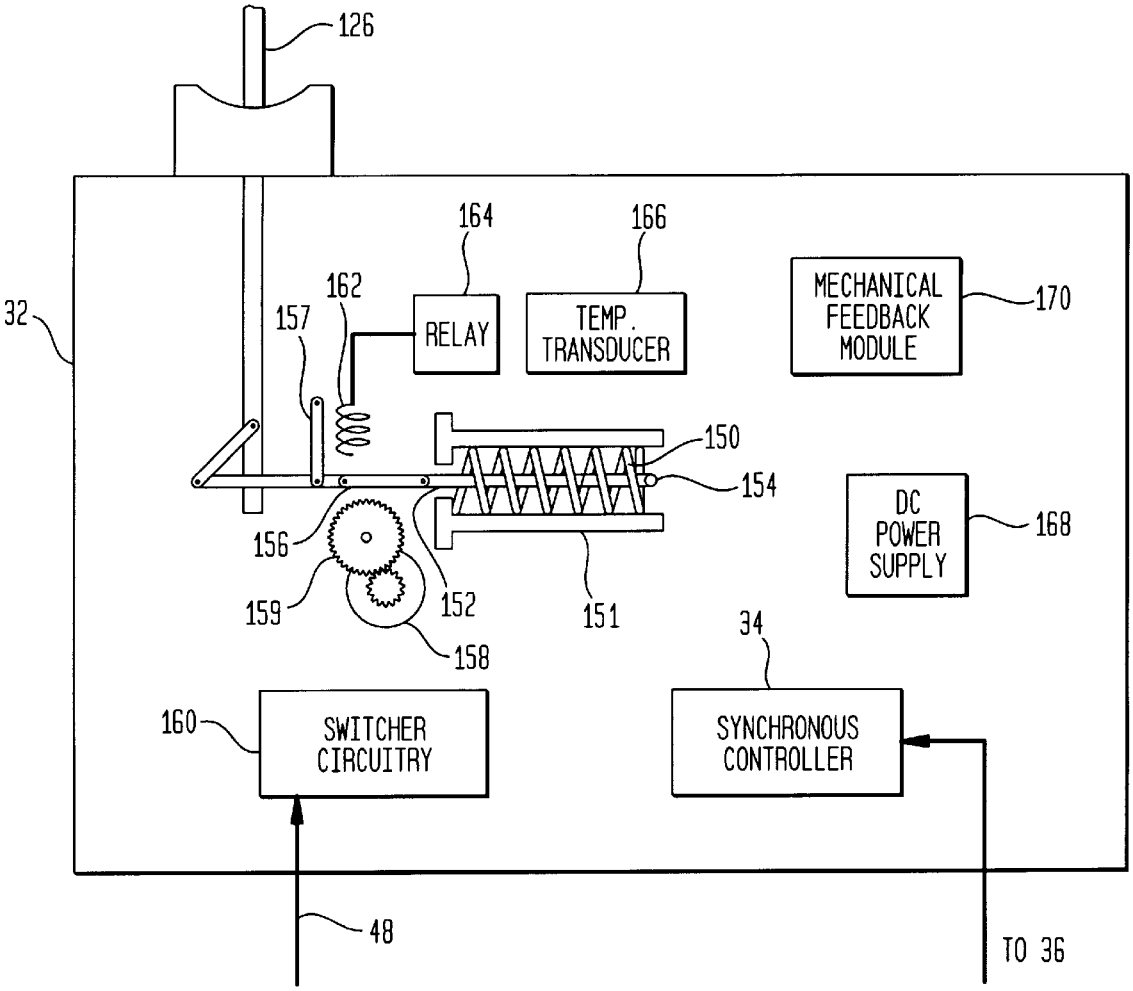
FIG. 4 is a diagrammatical view of the mechanical and electrical components of the control module for a capacitor switcher in accordance with the preferred embodiment of the present invention.

As shown in FIG. 4, the switch controller 32 contains synchronous controller 34, switcher circuitry 160, DC power supply 168, spring 150, spring charge motor 158, gearing 159, spring rod 152, spring rod latch 156, release lever 157, coil 162, relay 164, temperature transducer 166 and mechanical feedback module 170.

Alternatively, synchronous controller 34 may be physically separated from switch controller 32. For example, it could be housed in its own housing and separately attached to base assembly 98 or the like. It could then communicate with switch controller 32 via control wires or the like.

The DC power supply 168 is an auxiliary 24 volt DC power supply coupled that operates from the substation AC power. Spring rod 152 extends through the spring 150 and connects to a pin 154 which exerts force against the spring's end. Spring latch 156 couples the spring rod 152 to either the actuator rod 126 or to the gear system 159 of spring charge motor 158. The position of latch 156 is controlled by the switcher circuitry 160. When the latch 156 is in a position connecting the spring rod 152 to the actuator rod 126, the force of the spring 150 is transferred from the spring to the spring rod 152 and then to the actuator rod 126. Accordingly, when the spring releases force (e.g., it goes from a compressed position to an uncompressed position), actuator rod 126 is forced downwards. This, in turn, results in horizontal movement of rod 120, which, in turn, causes upward movement of rods 124.

The latch 156 can also be placed by the switch controller 32 so that it couples the spring rod 152 to motor gear system 159, which are turned by spring charge motor 158. The spring is compressed by the rotating of spring charge motor 158, which turns the gear system 159, which convert the rotational movement of the spring charge motor into horizontal movement of the spring rod 152. Therefore, when the motor turns, and latch 156 is in its correct position, the spring is compressed via movement of pin 154. When the spring is compressed, the switcher circuitry 160 turns the motor 158 off, and moves latch 156 to its other position, thereby connecting the spring rod 150 to actuator rod 126. In addition, switcher circuitry 160 places release lever 157 in position to hold spring rod 152 in place, thereby holding spring 150 in a charged position, and switcher circuitry 160 signals synchronous controller 34, notifying it that the spring 150 is compressed and is in position to close the switches.

The position of release lever 157 is controlled by a coil 162, which, in turn, is controlled by a relay 164, which, in turn, is controlled by synchronous controller 34 (as explained further below). When the release lever 157 is moved by coil 162, it releases the spring 150 and the spring de-energizes, leading to upward movement of rods 124. As explained further below, the timing of the movement of release lever 157 is controlled by synchronous controller 34.

Alternatively, as persons skilled in the art will appreciate, the spring 150 assembly can be replaced with any mechanical device that provides a suitable force for moving actuator rod 126, such as a hydraulic mechanism.

Switch controller 32 also contains a temperature transducer 166. The temperature transducer 166 measures the ambient temperature and sends a signal representative of the temperature to the synchronous controller 34, as explained further below. Preferably, the transducer should be located in the vicinity of the close coil 162 in the switch controller 32.

Turning now to FIG. 5, the structure of switches 30, 28 and 26 are illustrated in a grounded capacitor embodiment. Each switch comprises a stationary contact and a movable contact. Specifically, switch 30 has a stationary contact 200 and a movable contact 208; switch 28 has a stationary contact 202 and a movable contact 210; and switch 26 has a stationary contact 204 and a movable contact 212. Each movable contact 208, 210 and 212 is connected to a pull rod 124, which, in turn, is controlled by closing spring 150 as described above. When spring 150 de-energizes, each pull rod 124 is forced upwards at substantially the same time and at substantially the same velocity. This, in turn, moves each movable contact 208, 210 and 212 towards its respective stationary contact 200, 202 and 204 at substantially the same time and at substantially the same velocity (for example, at four meters per second for a 145 kV device with one contact per phase). When the movable contact makes contact with its respective stationary contact, a circuit path is completed between the respective terminal pads, i.e., 116 and 117, 114 and 115, and 112 and 113.

To achieve synchronous timing of the closure of switches 30, 28 and 26, stationary contacts 200, 202 and 204 are physically staggered at different distances from their respective movable contacts 208, 210 and 212. More particularly, the tip of each movable contact is located at a first plane 290, the tip of stationary contact 200 is located at a second plane 203, the tip of stationary contact 202 is located at a third plane 205, and the tip of stationary contact 204 is located at a fourth plane 207. Plane 203 is staggered at a distance 214 from plane 205, and plane 205 is staggered at a distance 216 from plane 207.

Since the movable contacts are all actuated by spring 150, each moves at substantially the same time, with substantially the same velocity, towards its respective stationary contact. Consequently, when the spring 150 is de-energized, movable contact 208 will first contact stationary contact 200, thereby connecting its respective capacitor bank to its respective phase C power line. Then, movable contact 210 will contact its respective stationary contact 202, thereby connecting its respective capacitor bank to its respective phase B power line, and finally, movable contact 212 will contact its respective stationary contact 204, thereby connecting its respective capacitor bank to its respective phase A power line.

Since the velocity of the movable contacts is known, or can be easily measured, and since the preferred timing of closure of the switches is known (provided the cycle and phase of the system is known), the required distance between a movable contact and its stationary contact can be easily calculated because this distance is a function of velocity and time. Each stationary contact should then be located at this calculated distance from its respective stationary contact to achieve synchronous closure of the switches. Preferably, after the stationary contacts are located, the stationary contacts or the movable contacts are arranged so that their locations can be further adjusted. This will allow for minor corrections in the distance between the movable contacts and stationary contacts to be made to account for fluctuations, such as wear and routine maintenance and calibration.

Figure 6:
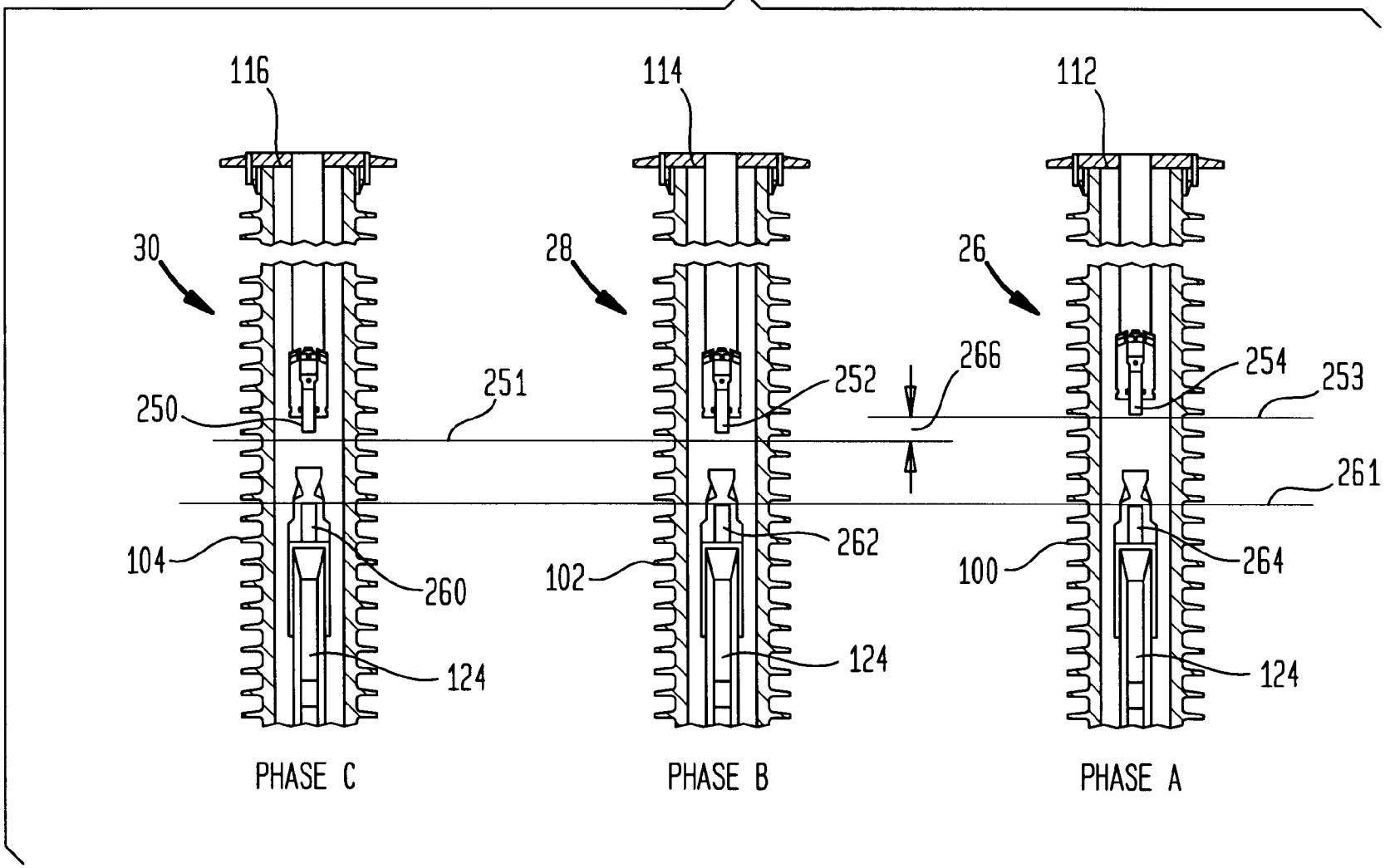
FIG. 6 is a detailed view of the contact structure of an ungrounded type capacitor switcher in accordance with the preferred embodiment of the present invention.

Turning to FIG. 6, the structure of switches 30, 28 and 26 for ungrounded capacitors is illustrated. The tips of each movable contact 260, 262 and 264 are located at a first plane 261, and the distance between the tips of stationary contacts 250 and 252 for phases C and B, respectively, are each located at a second plane 251. Thus, the tips of stationary contacts 250 and 252 are the same distance away from their respective movable contacts 260 and 262. The tip of stationary contact 254 for phase A is located at a third plane 253. Thus, the distance between the tip of stationary contact 254 and its movable contact 264 is staggered a further distance than those for phases C and B, as illustrated by reference numeral 266.

Consequently, when the pull rods 124 are actuated by spring 150, the movable contacts 260, 262 and 264 all move towards their respective stationary contacts at substantially the same time and at substantially same velocity. Thus, movable contacts 260 and 262 close against their respective stationary contacts 250 and 252 at substantially the same time. This is followed at a later time by movable contact 264 closing against its respective stationary contact 254.

As described above with respect to FIG. 5, the closing of the movable contacts 260, 262 and 264 against their respective stationary contacts 250, 252 and 254 completes a circuit path between the terminal pads 116 and 117, 114 and 115 and 112 and 113. Since pads 116, 114 and 112 are connected to capacitors 24, 22 and 20, respectively, and pads 117, 115 and 113 are connected to transmission lines 16, 14 and 12, respectively, the capacitors are switched into the lines when the movable contacts contact their respective stationary contacts.

Again, since the velocity of the movable contacts 260, 262 and 264 is known, or can be easily measured, and since the preferred timing of closure of the switches is known (provided the cycle and phase of the system is known), the required distance between a movable contact and its stationary contact can be easily calculated because distance is a function of velocity and time. Each stationary contact should then be located at this calculated distance from its respective stationary contact to achieve synchronous closure of the switches. Preferably, after the stationary contacts are located, the stationary contacts or the movable contacts are arranged so that their locations can be further adjusted. This will allow for minor corrections in the distance between the movable contacts and stationary contacts to be made to account for fluctuations, such as wear and routine maintenance and calibration.

In an alternative embodiment, the movable contacts of each switch (for either grounded or ungrounded capacitors) can be located at staggered distances from their respective stationary contacts (which can all be placed at a single plane). Such alternate arrangements do not deviate from the spirit or scope of the present invention.

Figure 7:
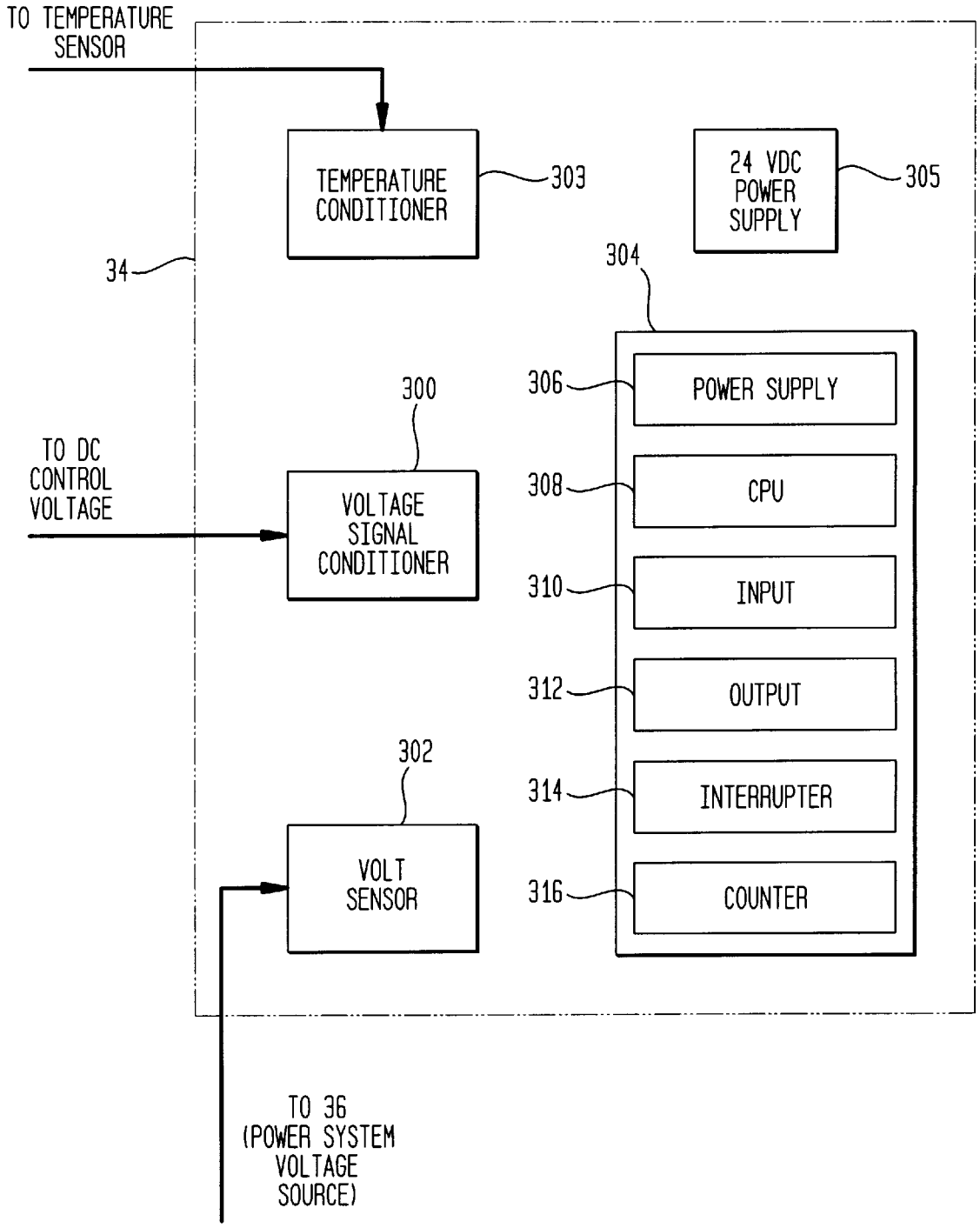
FIG. 7 is a block diagram of a synchronous controller is accordance with the preferred embodiment of the present invention.

Now, the timing control of spring 150 will be explained. As described above, the voltage waveform in the phase C distribution line is monitored via station potential transformer 36 and synchronous controller 34. As illustrated in FIG. 7, the synchronous controller 34 comprises a voltage signal conditioner 300, a voltage zero detector 302, a programmable logic controller ("PLC") 304, a temperature conditioner 303 and a 24 volt, DC power supply 305. The PLC consists of a power supply module 306, a central processing unit ("CPU") 308, an analog input module 310, an output module 312, an interrupter module 314 and a high speed counter 316.

The 24 VDC power supply 305 provides power to the PLC output module 312, high speed counter 316, voltage zero detector 302, temperature conditioner 303, and the voltage signal conditioner 300.

The voltage signal conditioner 300 converts the value of the substation DC control voltage from the DC power supply 168 to a 4 to 20 milliamp signal, and sends this signal to the analog input module 310 of the PLC 304 for use by the CPU 308, as explained below.

The temperature conditioner 303 converts the signal from the temperature transducer 166 to a 4 to 20 milliamp signal and sends this signal to the analog input module 310 of the PLC 304 for use by the CPU 308 as explained below.

The voltage zero detector 302 monitors the voltage of one phase of the power system by means of a signal provided from the station potential transformer 36. It provides a signal to the interrupt module 314 at voltage waveform zeros. An isolation transformer (not shown) in the voltage zero detector 302 is used to isolate the station potential transformer signal from the voltage zero detector 302 in order to minimize electrical interference.

The power supply module 306 provides a plus and minus five volt DC reference signal for use by the CPU 308 and the input and output modules 310 and 312.

The analog input module 310 is coupled to the temperature conditioner 303 and voltage signal conditioner 300. It receives analog signals indicative of the external temperature and DC control voltage, converts these values to digital signals, and sends them to the CPU.

Figure 8:
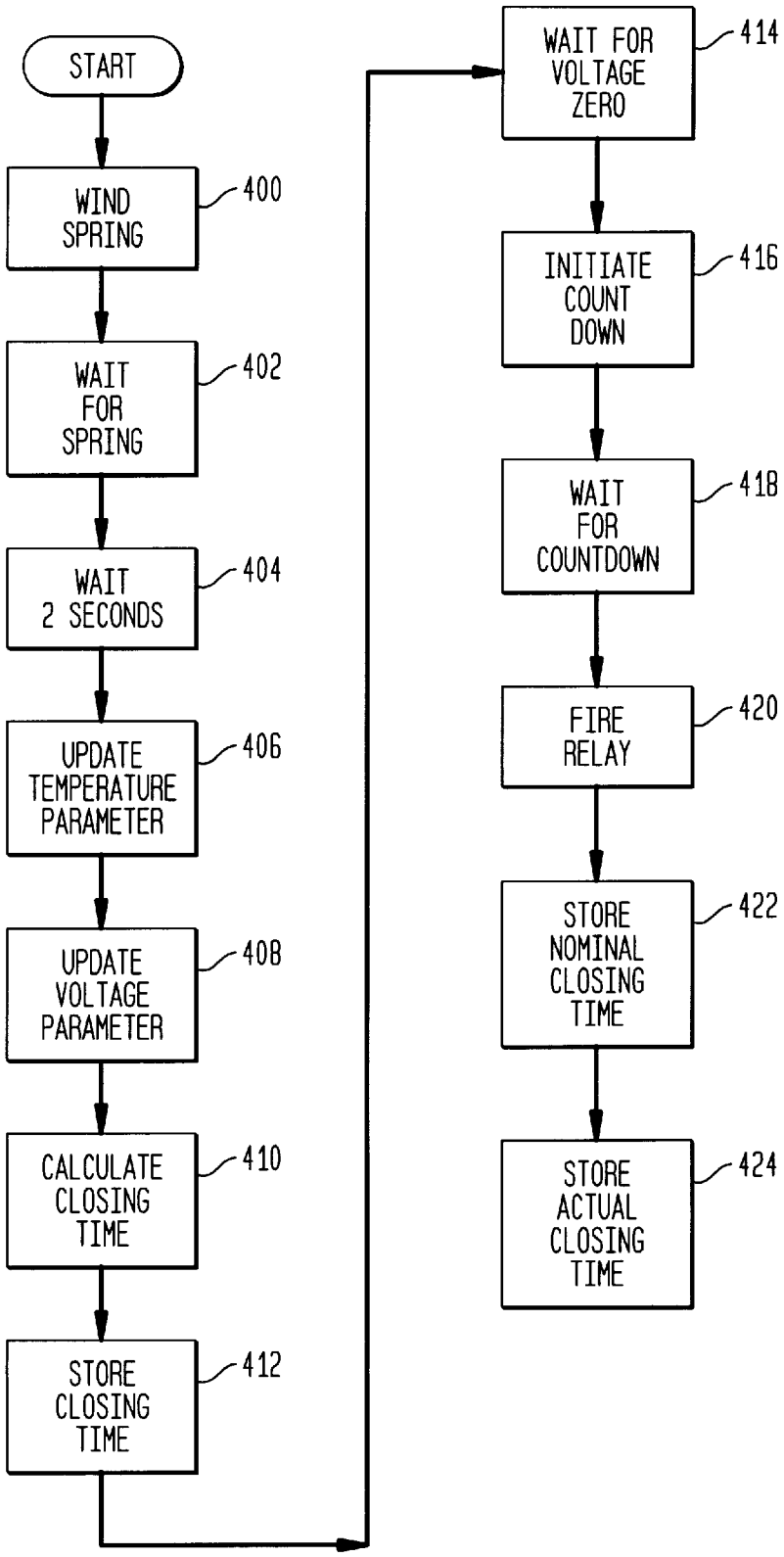
FIG. 8 is a flowchart of the structure of the computer program run by the synchronous controller in accordance with the preferred embodiment of the present invention.

The CPU 308 receives and processes: i) a signal from the voltage zero detector 302 indicating when the phase C voltage crosses zero potential, ii) a signal from the temperature conditioner 303 via analog input module 310 that indicates the value of the ambient temperature, and iii) a signal from the control voltage conditioner 300 via analog input module 310 indicating the value of the control voltage. In addition, the CPU contains an internal battery that can maintain the system with power off for periods of about three months. The CPU 308 has a RS-232 port (not shown). This port can be used to program the CPU, or to communicate with the CPU via modem. The CPU runs a program in a continuous loop, updating the closing parameters as temperature and control voltage change (as illustrated in FIG. 8) because these values affect the mechanical closing time of the capacitor switches.

Consequently, the synchronous controller 34 keeps track of zero crossings of the phase C voltage waveform, via voltage zero detector 302. All of the synchronous timing functions are based on the timing of the zero voltage crossing of phase C. Of course, phase C is illustrated by way of example, and any phase of any multi-phase power line could be monitored without deviating from the spirit or scope of the present invention.

When the switcher circuitry 160 receives a signal 48 requesting that the capacitors be switched into the system, the switch controller charges the spring 150, as described above. Thus, the spring 150 is charged just prior to actuation of the capacitor switches. In contrast, prior art capacitor springs or other actuator mechanisms are typically left in the charged position and are not charged up receipt of the signal requesting that the capacitors be switched into the system. For example, prior art springs or mechanisms are typically charged as soon as the device is powered on, or promptly after the capacitor switches are closed. Thus, prior art actuator mechanisms may be left for long periods of time, e.g., weeks or months, in the charged position while the device awaits a signal to switch the capacitors into the system.

The spring 150 of the present invention, however, is preferably charged after the switch controller 32 receives the control signal 48 requesting that the capacitors be switched into the system. Thus, since the spring is not compressed until needed, its energy will be more consistent, and, in turn, its velocity will be more consistent during decompression. Moreover, many of the mechanical parts of the switch controller 32 have a memory or static friction when left in one position for periods of time, such as the bearings, gears, joints, etc. These memories can have an adverse affect on the mechanical closing of the capacitor switches due to the fact that these bearings, gears and joints may thus hesitate and jerk. By charging the spring 150 just prior to actuation, many of the mechanical parts in switch controller 32 are thereby moved or jiggled, thereby decreasing any static friction or memory they may have had. The physical actuation of the capacitor switches of the present invention is therefore more smooth and consistent.

This is also true with alternative actuators (other than springs), such as a hydraulic mechanism. By charging the mechanism just prior to actuation of the capacitor switch, the mechanical parts of the switch are jiggled and thus their static friction is reduced. This provides for a smoother and more consistent actuation of the capacitor switch, which results in more accurate timing.

When the spring 150 is charged, and latch 156 and lever 157 are in position, switcher circuitry 160 sends a signal to the interrupt module 314, and the interrupt module then interrupts the CPU 308 program loop. The CPU then executes an interrupt program (as illustrated in FIG. 8). Specifically, the CPU first waits about two seconds for the control voltage to stabilize, then it calculates the time delay associated with closing switch 30. The CPU then waits for the next zero crossing signal from the voltage zero detector 302, and then signals this time delay value to the output module 312. The output module 312 then resets the high speed counter 316 and the counter begins to count down this time delay. The high speed counter 316 is an accurate clock that counts at 1 microsecond intervals until the CPU calculated time delay value is reached. The counter 316 then notifies the output module 312 that the time delay has been reached, and the output module sends a synchronous closing signal command to relay 164, which latches the relay. This, in turn, energizes the closing coil 162, which, in turn, moves lever 157, which releases the spring 150.

The close time of the circuit switcher is measured on each operation via mechanical feedback module 170. This close time is sent to the CPU 308 and stored in a storage register. This register can be accessed by a user via a modem coupled to the RS-232 port of the CPU 308, and these close times can therefore be analyzed. The user can then make adjustments to the CPU's program to adjust its timing calculations to account for any timing discrepancies. Accordingly, the synchronous controller 34 can be adjusted by the user to account and adjust for timing changes due to wear, friction, lubricant or the like that may lead to minor variations in the nominal close time over the lifetime of the equipment.

A flowchart of the interrupt operation of the CPU program is illustrated in FIG. 8. It first sends a signal to switch controller 32 to wind/energize the spring 150 as indicated by step 400, and then it awaits a signal from switch controller 32 indicating that the spring 150 is wound/charged as indicated by step 402. After it receives a signal from switch controller 32 indicating that the spring 150 is wound/energized, it then waits two seconds for the for control voltage to stabilize as indicated by step 404. It then updates the temperature and voltage parameters as indicated by steps 406 and 408. As described above, these values are provided by the temperature conditioner 303 and voltage signal conditioner 300 via analog input module 310.

The CPU 308 then calculates the nominal closing time delay as indicated by step 410, and stores this value as indicated by step 412. The CPU 308 then waits for a voltage zero detection as indicated by step 414, and, after it is received, it initiates a count-down of the nominal closing time delay as indicated by step 416. It then waits for the delay to be counted down as indicated by step 418, at which time it fires the relay 164 to release the spring 150 as indicated by step 420.

The CPU 308 then stores the nominal closing time delay calculation in a storage register as indicated by step 422, and receives a signal representative of the actual closing time from switch controller 32. The CPU then stores this actual closing time in a storage register as indicated by step 424. As described above, these storage registers are accessible to the user via modem through the CPU RS-232 port. The user can then compare the nominal closing time delay calculation to the actual closing time, and then can make adjustments to the CPU's program to account for discrepancies due to wear, lubrication, etc.

While one embodiment of a capacitor switcher and several modifications thereof have been described in detail herein, various other changes and modifications may be made without departing from the scope of the present invention.

What is claimed is:

1. A three-phase, high-voltage, capacitor switching device, comprising:

three switches, each switch comprising a movable contact and a stationary contact, and each switch movable between an open and closed position, the movable contact contacting said stationary contact when the switch is in the closed position; and the stationary contact of the first switch positioned a first distance from the respective movable contact when the switch is in the open position, the stationary contact of the second switch positioned a second distance, greater than the first distance, from the respective movable contact when the second switch is in an open position, and the stationary contact of the third switch positioned a third distance, greater than the second distance, from the respective movable contact when the third switch is in an open position.

2. The device of claim 1 wherein each switch begins its movement from the open position to the closed position at substantially the same time as each other switch when each switch moves from its open position to its closed position.

3. The device of claim 2 wherein each of the switches arrives at the closed position at different times.

4. The device of claim 2 wherein each movable contact moves towards the respective stationary contact at substantially the same velocity when each switch moves from the open position to the closed position.

5. The device of claim 1 further comprising at least one spring that moves each of said movable contacts of each switch from the open position to the closed position.

6. The device of claim 5 wherein the at least one spring releases from an energized position to cause said movement, and the at least one spring is energized just prior to moving the movable contacts.

7. The device of claim 5 further comprising a synchronous controller that signals the release of said at least one spring.

8. The device of claim 7 wherein:

when in the closed position, each switch completes a circuit path between one phase of a three-phase alternating current transmission line and a capacitor;

the synchronous controller monitors the voltage signal in one phase of the three-phase line and times the issuance of the release signal so that one of the movable contacts will contact the respective stationary contact when the voltage signal in the associated phase of the transmission line is predicted by the synchronous controller circuit to be substantially at zero potential.

9. The device of claim 8 further comprising:

a temperature sensor that measures the ambient temperature; and the synchronous controller adjusts the timing of the release signal in accordance with the temperature measurement.

10. The device of claim 8 further comprising:

a control voltage sensor that measures the control voltage; and the synchronous controller adjusts the timing of the release signal in accordance with the control voltage measurement.

11. The device of claim 8 further comprising:

a control voltage sensor that measures the control voltage;

a temperature sensor that measures the ambient temperature; and the synchronous controller adjusts the timing of the release signal in accordance with the control voltage measurement and the temperature measurement.

12. The device of claim 1 wherein, when in the closed position, each switch completes a circuit path between an associated phase of a three-phase transmission line and a capacitor.

13. The device of claim 12 wherein each switch begins its transition from the open position to the closed position at substantially the same time as each other switch.

14. The device of claim 13 wherein each of the switches arrives at the closed position at different times.

15. The device of claim 14 wherein each movable contact moves towards the respective stationary contact at substantially the same velocity when each switch moves from the open position to the closed position.

16. The device of claim 15 further comprising at least one spring that moves each of said movable contacts of each switch from the open position to the closed position.

17. The device of claim 16 wherein the at least one spring releases from an energized position to cause said movement, and the at least one spring is energized just prior to moving the movable contacts.

18. The device of claim 17 further comprising a synchronous controller that signals the release of said at least one spring.

19. The device of claim 18 wherein:

the synchronous controller monitors the voltage in one phase of a three-phase transmission line;

said one phase of the three-phase transmission line is coupled to said first switch;

the synchronous controller circuit calculates the closing time associated with closing the first switch;

the synchronous controller circuit calculates when the voltage signal in the first transmission line will be substantially at zero potential;

the synchronous controller circuit times the issuance of the release signal to the spring so that the first switch closes when the voltage signal in the first transmission line is calculated to be substantially at zero potential.

20. The device of claim 19 wherein:

the second switch is coupled to a second phase of the three-phase transmission line;

the third switch is coupled to the third phase of the three-phase transmission line;

the movable contacts and their respective stationary contacts of the second and third switches spaced at distances so that each switch closes when the voltage signal in their respective transmission line is calculated to be substantially at zero potential.

21. A three-phase high voltage capacitor switching device, comprising:

three switches, each movable between an open and closed position, the movable contact contacting said stationary contact when in the closed position;

the stationary contact of the first switch positioned at a first distance from the respective movable contact when the first switch is in an open position;

the stationary contact of the second switch positioned at a second distance, greater than the first distance, from the respective movable contact when the second switch is in an open position; and the stationary contact of the third switch positioned at a third distance, greater than the second distance, from the respective movable contact when the third switch is in an open position.

22. The device of claim 21 wherein each movable contact is coupled to a spring that moves the movable contacts towards their respective stationary contacts.

23. The device of claim 22 further comprising a synchronous controller that monitors the voltage signal in one phase of a three phase AC transmission line, and controls the actuation of the spring to move the movable contacts.

24. The device of claim 23 wherein the synchronous controller times the actuation of the spring to close the switch associated with the transmission line it monitors when the voltage signal in that line is predicted by the synchronous controller to be substantially at zero potential, and the different distances between the movable contacts and stationary contacts of the other two switches delaying the contact of those movable contacts with their respective stationary contact until the voltage signals in the lines associated with those two switches are calculated to be substantially at zero potential.

25. A contact device for switching an ungrounded high voltage capacitor bank into a three-phase distribution line, comprising:

three capacitor switches, one for each phase, and each comprising a movable contact and a stationary contact;

each movable contact located at a length from the respective stationary contact when the switches are in an open position;

said length for two of the switches being substantially the same;

said length for the third switch being longer than the other two switches.

26. The device of claim 25 further comprising:

at least one spring that moves each movable contact of each switch from the open position to a closed position wherein the movable contact contacts the respective stationary contact.

27. The device of claim 26 wherein the at least one spring moves each movable contact towards the respective stationary contact at substantially the same velocity.

28. The device of claim 26 wherein the at least one spring starts the movement of each movable contact towards the respective stationary contact at substantially the same time.

29. The device of claim 26 wherein said at least one spring moves each movable contact towards the respective stationary contact at substantially the same velocity, and starts the movement of each movable contact towards the respective stationary contact at substantially the same time.

30. The device of claim 26 further comprising a synchronous control circuit that signals the at least one spring to close said switches.

31. The device of claim 30 wherein the synchronous control circuit detects the voltage zero crossing of the voltage signal in one of said phases.

32. The device of claim 31 wherein said synchronous control circuit times its signal to the at least one spring to close said two switches when the voltage signals in the associated two phases are substantially equal.

33. The device of claim 31 wherein said further length of said third switch causes the third switch to close after the other two switches, and when said voltage signal in the associated third phase is substantially zero.

34. The device of claim 31 further comprising a temperature sensor that measures the ambient temperature and the synchronous controller adjusts the timing of the respective close signal in accordance with the temperature measurement.

35. The device of claim 31 further comprising a control voltage sensor that measures the control voltage and the synchronous controller adjusts the timing of the respective close signal in accordance with the control voltage measurement.

36. The device of claim 31 further comprising:

a temperature sensor that measures the ambient temperature;

a control voltage sensor that measures the control voltage;

and the synchronous controller adjusts the timing of the respective close signal in accordance with the control voltage measurement and the temperature measurement.

37. A high voltage capacitor switching device for switching capacitors into a multi-phase distribution line, comprising:

at least two switches, each switch comprising a movable contact and a stationary contact, and each switch movable between an open and closed position, the movable contact contacting the respective stationary contact when the switch is in the closed position;

the distance between the stationary contact and movable contact of at least two of the switches being different when said two switches are in an open position; and each switch begins the respective transition from the open to closed position at substantially the same time, and each movable contact moves at substantially the same velocity as each other movable contact when each switch is in transition between the open position and the closed position.

38. The device of claim 37 wherein said at least two switches is three switches, and two of said switches have substantially the same distance between their movable contacts and respective stationary contacts when the switches are in the open position.

39. The device of claim 38 wherein the distance between the movable contact and stationary contact of the third switch is greater than the distance of the other two switches.

40. The device of claim 29 wherein said at least two switches comprise three switches, and one of said switches has a first distance between the respective movable contact and the respective stationary contact when in the open position; another of said switches has a second distance, greater than the first distance, between the respective movable contact and the respective stationary contact when in an open position; and the last of said switches has a third distance, greater than the second distance, between the respective movable contact and the respective stationary contact when in an open position.

41. A method of synchronizing the closure of a multi-phase capacitor switch, comprising:

positioning at least two switches, each switch comprising a movable contact and a stationary contact, in an open position by placing each movable contact and the respective stationary contact at selected distances from each other;

moving said at least two switches from said open position by moving each of said movable contact towards the respective stationary contact at substantially the same time and at substantially the same velocity so that at least one of said movable contacts contacts the respective stationary contact at a first selected time and at least one other of said movable contacts contacts the respective stationary contact at a subsequent, second selected time.

42. The method of claim 41 wherein said at least two switches is three switches, and two of said switches have substantially the same selected distance between their movable contacts and respective stationary contacts when placed in the open position.

43. The method of claim 42 wherein the selected distance between the movable contact and stationary contact of the third switch is greater than the selected distance of the other two switches.

44. The method of claim 41 wherein said at least two switches comprise three switches, and one of said switches has a first selected distance between the respective movable contact and the respective stationary contact; another of said switches has a second selected distance, greater than the first selected distance, between the respective movable contact and the respective stationary contact; and the last of said switches has a third selected distance, greater than the second selected distance, between the respective movable contact and the respective stationary contact.

45. A switch controller for moving a high-voltage capacitor switch from an open position to a closed position, comprising:

an actuator coupled to the capacitor switch for moving the switch from the open position to the closed position when the actuator transitions from an energized state to a deenergized state;

an actuator energizer that energizes the actuator and places it in the energized state;

an input that receives a control signal requesting that the switch be moved from the open position to the closed position;

said actuator energizer coupled to the input and energizing said actuator in response to said control signal;

said capacitor comprising three sets of capacitors;

said switch comprising three sets of contacts, each set of contacts comprising a movable contact and a stationary contact;

said actuator coupled to each of said movable contacts such that when said actuator transitions from the respective energized state to the respective deenergized state, each movable contact moves toward the respective stationary contact, wherein, when said actuator begins the respective transition from the respective energized state to the respective deenergized state, each movable contact begins the respective movement towards the respective stationary contact at substantially the same time;

wherein each movable contact is at a selected distance from the respective stationary contact when the capacitor switch is in an open position;

wherein the first set of contacts are at a first selected distance, the second set of contacts are at a second selected distance, and the third set of contacts are at a third selected distance; and wherein said first and second selected distances are equal, and said third selected distance is greater than said first and second distances.

46. A switch controller for moving a high-voltage capacitor switch from an open position to a closed position, comprising:

an actuator coupled to the capacitor switch for moving the switch from the open position to the closed position when the actuator transitions from an energized state to a deenergized state;

an actuator energizer that energizes the actuator and places it in the energized state;

an input that receives a control signal requesting that the switch be moved from the open position to the closed position;

said actuator energizer coupled to the input and energizing said actuator in response to said control signal;

said capacitor comprising three sets of capacitors;

said switch comprising three sets of contacts, each set of contacts comprising a movable contact and a stationary contact;

said actuator coupled to each of said movable contacts such that when said actuator transitions from the respective energized state to the respective deenergized state, each movable contact moves toward the respective stationary contact, wherein, when said actuator begins the respective transition from the respective energized state to the respective deenergized state, each movable contact begins the respective movement towards the respective stationary contact at substantially the same time;

wherein each movable contact is at a selected distance from the respective stationary contact when the capacitor switch is in an open position;

the first set of contacts at a first selected distance, the second set of contacts at a second selected distance, and the third set of contacts at a third selected distance;

wherein said second selected distance is greater than said first selected distance and said third selected distance is greater than said second selected distance.

* * * * *